US005296309A

United States Patent [19]

Benz et al.

[11] Patent Number: 5,296,309

[45] Date of Patent: Mar. 22, 1994

[54] COMPOSITE STRUCTURE WITH NBTIALCR ALLOY MATRIX AND NIOBIUM BASE METAL REINFORCEMENT

[75] Inventors: Mark G. Benz, Burnt Hills; Melvin R. Jackson, Schenectady; John R. Hughes, Scotia, all of N.Y.

[73] Assignee: General Electric Company, Schenectady, N.Y.

[21] Appl. No.: 816,161

[22] Filed: Jan. 2, 1992

[51] Int. Cl.[5] ..... C22C 1/09

[52] U.S. Cl. ..... 428/614; 420/426

[58] Field of Search ..... 428/614; 420/426; C22C 1/9

[56] References Cited

U.S. PATENT DOCUMENTS

| | | | |
|---|---|---|---|
| 3,753,699 | 8/1973 | Anderson, Jr. et al. | 420/426 |
| 3,828,417 | 8/1974 | Divecha | 428/614 |
| 4,059,441 | 11/1977 | Ray et al. | 420/426 |
| 4,127,700 | 11/1978 | Stöckel et al. | 75/234 |
| 4,990,308 | 2/1991 | Jackson | 420/426 |

FOREIGN PATENT DOCUMENTS

| | | | |
|---|---|---|---|
| 0372312 | 6/1990 | European Pat. Off. . | |
| 47-21357 | 1/1968 | Japan . | |
| 43-2818 | 2/1968 | Japan . | |
| 47-25559 | 10/1968 | Japan . | |
| 55-110747 | 8/1980 | Japan | 428/614 |
| 1-215937 | 8/1989 | Japan . | |

OTHER PUBLICATIONS

D. W. Petrasek and R. H. Titran, "Creep Behavior of Tungsten/Niobium and Tungsten/Niobium-1 Percent Zirconium Composites", Report No. DOE/-NASA/16310-5 NASA TM-100804 (Jan. 11-14 1988) pp. 1-21.

S. T. Wlodek, "The Properties of Cb-Ti-W Alloys. Part I. Oxidation," Columbium Metal., D. Douglass et al., eds., AIME Metallurgical Society Conferences, vol. 10, Interscience Publishers, NY (1961) pp. 175-203. (no month).

S. T. Wlodek, "The Properties of Cb-Al-V Alloys. Part I. Oxidation," ibid., pp. 553-583. 1961 (no month).

S. Priceman & L. Sama, "Fused Slurry Silicide Coatings for the Elevated Temperature Oxidation of Columbium Alloys", Refractory Metals & Alloys IV-TMS Conf. Proc., vol. II, RI, G. M. Jaffee et al., eds., Gordon & Breach Science Pbls., NY (1966) pp. 959-982. (no month).

M. R. Jackson and K. D. Jones, "Mechanical Behavior of Nb-Ti Base Alloys", Refractory Metals, etc., K. C. Liddell et al. eds., TMS, Warrendale, Penna. (1990) pp. 311-320.

M. R. Jackson, K. D. Jones, S-C Huang, & L. A. Peluso, "Response of Nb-Ti Alloys to High Temperature Air Exposure", CR&D Technical Report No. 90CRD182 (Sep. 1990) pp. 1-15.

M. G. Hebsur & R. H. Titran, "Tensile and Creep-Rupture Behavior of P/M Processed Nb-Base Alloy, WC-3009", Refractory Metals: State-of-the-Art 1988, P. Kumar & R. L. Ammon, eds., TMS, Warrendale, Penna. (1989) pp. 39-48. (no month).

M. R. Jackson, P. A. Siemers, S. F. Rutkowski, & G. Frind, "Refractory Metals Structures Produced by Low Pressure Plasma Deposition", ibid., pp. 107-118. 1989 (no month).

*Primary Examiner*—Michael Lewis
*Assistant Examiner*—N. M. Nguyen
*Attorney, Agent, or Firm*—James Magee, Jr.

[57] ABSTRACT

Composite structures having a higher density, stronger reinforcing niobium based alloy embedded within a lower density, lower strength niobium based alloy are provided. The matrix is preferably an alloy having a niobium and titanium base according to the expression:

$$Nb_{balance}\text{-}Ti_{32\text{-}48}\text{-}Al_{8\text{-}16}\text{-}Cr_{2\text{-}12}.$$

The reinforcement may be in the form Of strands of the higher strength, higher temperature niobium based alloy. The same crystal form is present in both the matrix and the reinforcement and is specifically body centered cubic crystal form.

10 Claims, 9 Drawing Sheets

CROSS SECTION OF DOUBLE-EXTRUDED COMPOSITE

CROSS SECTION OF
DOUBLE-EXTRUDED COMPOSITE

500 Microns

AS-30 AS-EXTRUDED
CONTINUOUS FIBERS

COMPOSITE STRUCTURE WITH NBTIALCR ALLOY MATRIX AND NIOBIUM BASE METAL REINFORCEMENT

CROSS REFERENCE TO RELATED APPLICATIONS

The subject applications relate to the copending application as follows: Ser. No. 07/816,164 filed Jan. 2, 1992, Ser. No. 07/815,794 filed Jan. 2, 1992, Ser. No. 07/815,797 filed Jan. 2, 1992, and Ser. No. 07/816,165 filed Jan. 2, 1992.

The text of these related applications are incorporated herein by reference.

BACKGROUND OF THE INVENTION

The present invention relates to metal structures in which a metal matrix having a lighter weight and a lower tensile strength at high temperature is reinforced by filaments of a metal present in lower volume fraction but having both higher tensile strength and higher density than that of the matrix. The invention further relates to the reinforcement of lower density metal matrix composites having a niobium titanium base matrix and a higher oxidation resistance, with metal reinforcement having a lower oxidation resistance as well as higher density and higher strength.

The invention additionally relates to body centered cubic metal structures in which a metal matrix having a lower density and a lower tensile strength at high temperature is reinforced by filaments of a metal present in lower volume fraction but having both higher tensile strength and higher density than that of the matrix. Lastly, the invention relates to metal-metal composite structures in which a lower density metal matrix having a niobium titanium base and a higher oxidation resistance is reinforced with denser, but stronger, niobium base metal reinforcing filaments having a lower oxidation resistance.

It is known that niobium base alloys have useful strength in temperature ranges at which nickel and cobalt base superalloys begin to show incipient melting. This incipient melting temperature is in the approximately 2300 to 2400° F. range. The use of the higher melting niobium base metals in advanced jet engine turbine hot sections would allow higher metal temperatures than are currently allowed. Such use of the niobium base alloy materials could permit higher flame temperatures and would also permit production of greater power at greater efficiency. Such greater power production at greater efficiency would be at least in part due to a reduction in cooling air requirements.

The commercially available niobium base alloys have high strength and high density but have very limited oxidation resistance in the range of 1600° F. to 2400° F. Silicide coatings exist which might offer some protection of such alloys at temperatures up to 2400° F., but such silicide coatings are brittle enough that premature failure of the coating could be encountered where the coated part is highly stressed. The commercially available niobium base alloys also have high densities ranging from a low value of 8.6 grams per cubic centimeter for relatively pure niobium to values of about 10 grams per cubic centimeter for the strongest alloys.

Certain alloys having a niobium-titanium base have much lower densities of the range 6–7 grams per cubic centimeter. A group of such alloys are the subject matter of commonly owned U.S. Pat. Nos. 4,956,144; 4,990,308; 5,006,307; 5,019,334; and 5,026,522. Such alloys can be formed into parts which have significantly lower weight than the weight of the presently employed nickel and cobalt superalloys as these superalloys have densities ranging from about 8 to about 9.3 grams per cubic centimeter. One of these patents, U.S. Pat. No. 4,990,308, concerns an alloy having the following composition in atom percent:

| Ingredient | Concentration Range |
|---|---|
| niobium | balance |
| titanium | 32–48% |
| aluminum | 8–16% |
| chromium | 2–12% |

A number of additional niobium based alloys are also the subject of commonly owned U.S. Patents. These patents are U.S. Pat. Nos. 4,890,244; 4,931,254; 4,983,356; and 5,000,913 This latter group of alloys has uniquely valuable sets of properties but have densities which are higher than those of the other alloys Commonly owned U.S. Pat. No. 4,904,546 concerns an alloy system in which a niobium base alloy is protected from environmental attack by a surface coating of an alloy highly resistant to oxidation and other atmospheric attack.

In devising alloy systems for use in aircraft engines the density of the alloys is, of course, a significant factor which often determines whether the alloy is the best available for use in the engine application. The nickel and cobalt based superalloys also have much greater tolerance to oxygen exposure than the commercially available niobium based alloys. The failure of a protective coating on a nickel or cobalt superalloy is a much less catastrophic event than the failure of a protective coating on many of the niobium based alloys and particularly the commercially available niobium based alloys. The oxidation resistance of the niobium based alloys of the above commonly owned patents is intermediate between the resistance of commercial Nb base alloys and that of the Ni- or Co-based superalloys.

While the niobium based alloys of the above commonly owned patents are stronger than wrought nickel or cobalt based superalloys at high temperatures, they are much weaker than cast or directionally solidified nickel or cobalt based superalloys at these higher temperatures. However, for many engine applications, structures formed by wrought sheet fabrication are used, since castings of sheet structures cannot be produced economically in sound form for these applications.

The advantage of use of niobium based structures is evidenced by the fact that the niobium based alloys can withstand 3 ksi for 1000 hours at temperatures of 2100° F. The nickel and cobalt based wrought superalloys, by contrast, can withstand 3 ksi of stress for 1000 hours at only 1700 to 1850° F.

What is highly desirable in general for aircraft engine use is a structure which has a combination of lower density, higher strength at higher temperatures, good ductility at room temperature, and higher oxidation resistance. We have devised metal-metal composite structures which have such a combination of properties.

A number of articles have been written about use of refractory metals in high temperature applications. These articles include the following:

(1) Studies of composite structures of tungsten in niobium were performed at Lewis Research Center by D. W. Petrasek and R. H. Titran and are reported in a report entitled "*Creep Behavior of Tungsten/Niobium and Tungsten/Niobium-1 Percent Zirconium Composites*" and identified as Report No. DOE/NASA/16310-5 NASA TM-100804, prepared for Fifth Symposium on Space Nuclear Power Systems, University of New Mexico, Albuquerque, N.M. (Jan. 11-14 1988). No studies of reinforcing niobium base matrices with niobium base structures, nor the unique benefits of such reinforcing, is taught in this report.

(2) S. T. Wlodek, "*The Properties of Cb-Ti-W Alloys, Part I*", Oxidation Columbium Metallurgy, D. Douglass and F. W. Kunz, eds., AIME Metallurgical Society Conferences, vol. 10, Interscience Publishers, New York (1961) pp. 175-204.

(3) S. T. Wlodek, "*The Properties of Cb-Al-V Alloys, Part I*", Oxidation ibid., pp 553-584.

(4) S. Priceman and L. Sama, "*Fused Slurry Silicide Coatings for the Elevated Temperature Oxidation of Columbium Alloys*", Refractory Metals and Alloys IV—TMS Conference Proceedings, French Lick, Ind., Oct. 3-5, 1965, vol. II, R. I. Jaffee, G. M. Ault, J. Maltz, and M. Semchyshen, eds., Gordon and Breach Science Publisher, New York (1966) pp. 959-982.

(5) M. R. Jackson and K. D. Jones, "*Mechanical Behavior of Nb-Ti Base Alloys*", Refractory Metals: Extraction, Processing and Applications, K. C. Liddell, D. R. Sadoway, and R. G. Bautista, eds , TMS, Warrendale, Pa. (1990) pp. 311-320.

(6) M. R. Jackson, K. D. Jones, S. C. Huang, and L. A. Peluso, "*Response of Nb-Ti Alloys to High Temperature Air Exposure*", ibid., pp. 335-346.

(7) M. G. Hebsur and R. H. Titran, "*Tensile and Creep Rupture Behavior of P/M Processed Nb-Base Alloy,* WC-3009", Refractory Metals: State-of-the-Art 1988, P. Kumar and R. L. Ammon, eds., TMS, Warrendale, Pa. (1989) pp. 39-48.

(8) M. R. Jackson, P. A. Siemers, S. F. Rutkowski, and G. Frind, "*Refractory Metal Structures Produced by Low Pressure Plasma Deposition*", ibid , pp. 107-118.

BRIEF STATEMENT OF THE INVENTION

In one of its broader aspects, objects of the present invention can be achieved by embedding reinforcing strands of a niobium base metal of greater high temperature tensile strength and lower oxidation resistance within a niobium base matrix metal of lower strength and higher oxidation resistance having the following composition in atom percent:

$Nb_{balance}$-$Ti_{32-48}$-$Al_{8-16}$-$Cr_{2-12}$, provided that the sum (Al+Cr)<=22a/o and where Ti is less than 37a/o the sum (Al+Cr)<=16a/o, where each metal of the metal/metal composite has a body centered cubic crystal structure, and said composite being ductile, and having higher tensile and rupture strength at temperatures above 1,000 degrees Centigrade than that of the matrix alloy.

In another of its broader aspects, objects of the present invention can be achieved by embedding a niobium base metal having a body centered cubic crystal form and having higher density and greater high temperature strength as well as a lower oxidation resistance in a matrix having a niobium titanium base and having lower density, lower strength and higher oxidation resistance and having the following composition:

$Nb_{balance}$-$Ti_{32-36.9}$-$Al_{8-12}$-$Cr_{2-8}$, provided the sum (Al+Cr)<=16a/o, and said composite being ductile and having higher tensile and rupture strength at temperatures above 1,000 degrees Centigrade than that of the matrix.

In still another of its broader aspects, objects of the present invention can be achieved by embedding a niobium base metal having a body centered cubic crystal form and having higher density and greater high temperature strength as well as a lower oxidation resistance in a matrix having a niobium titanium base and having lower density, lower strength and higher oxidation resistance and having the following composition:

$Nb_{balance}$-$Ti_{42.5-48}$-$Al_{8-16}$-$Cr_{2-10}$ provided the sum (Al+Cr)<=22a/o, and said composite being ductile and having higher tensile and rupture strength at temperatures above 1,000 degrees Centigrade than that of the matrix.

BRIEF DESCRIPTION OF THE DRAWINGS

The description which follows will be understood with greater clarity if reference is made to the accompanying drawings in which.

DETAILED DESCRIPTION OF THE INVENTION

Figure 1:
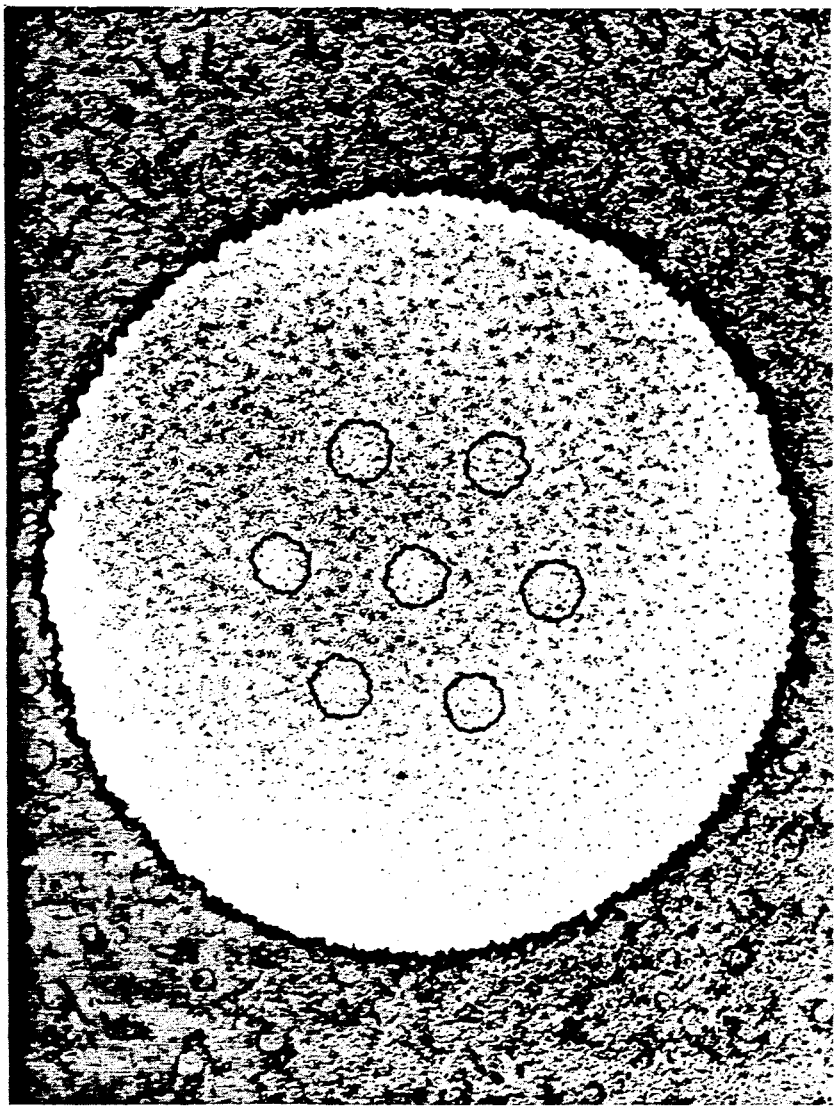
FIG. 1 is a photomicrograph of the cross section of a billet prepared by the method of the present invention.

Pursuant to the present invention, composite structures are formed incorporating strong ductile metallic reinforcing elements in a ductile, low density, more oxygen-resistant matrix to achieve greater high temperature tensile and rupture strengths than can be achieved in the matrix by itself and to achieve avoidance of the oxidative degradation of the reinforcement.

Both the reinforcement composition and the matrix composition are high in niobium metal. Further, both the matrix and the reinforcement have the same general crystalline form and specifically a body centered cubic crystal structure. In this way, many of the problems related to incompatibility of or interaction between the reinforcement and the matrix to form brittle intermetallics or other undesirable by-products are deemed to be avoided. If a composite containing fiber reinforcement is heated for long times at high temperature, the fiber and matrix are mutually soluble so that even a high degree of interdiffusion does not result in embrittlement. However, for normal service lives and temperatures, very little interdiffusion and very little degradative alteration of the respective properties of the matrix and reinforcement are deemed likely.

In general, the fabrication techniques for forming such composites involve embedding a higher strength, higher density ductile niobium base alloy in an envelope of the lower density, lower strength ductile niobium base alloy and forming and shaping the combination of materials into a composite body. In this way, it is possible to form a composite which is strengthened by the greater high temperature strength of the higher density niobium alloy and which enjoys the environmental resistance properties of the weaker matrix material.

The following examples illustrate some of the techniques by which the composites of the present invention may be prepared and the properties achieved as a result of such preparation.

EXAMPLES 1 AND 2

Two melts of matrix alloys were prepared and ingots were prepared from the melts. The ingots had compositions as listed in Table I immediately below.

TABLE I

| | | | | | |
|---|---|---|---|---|---|
| Matrix Alloy 108: | 40Nb | 40Ti | 10Al | 8Cr | 2Hf |
| Matrix Alloy 124: | 49Nb | 34Ti | 8Al | 7Cr | 2Hf |

The alloys prepared were identified as alloys 108 and 124. The composition of the alloys is given in Table I in atom percent. The alloy 108 containing 40 atom percent titanium and 40 atom percent niobium is a more oxygen resistant or oxygen tolerant alloy, and the matrix alloy identified as alloy 124 containing 34 atom percent titanium and 49 atom percent niobium is the stronger of the two matrix alloy materials at high temperature.

A Wah Chang commercial niobium based reinforcing alloy was obtained containing 30 weight percent of hafnium and 9 weight percent of tungsten in a niobium base. The alloy was identified as WC3009.

A cast ingot of each of the matrix alloy compositions was first prepared in cylindrical form. Seven holes were drilled in each of the ingots of cast matrix alloy to receive seven cylinders of the reinforcing material. The seven holes were in an array of six holes surrounding a central seventh hole. Each of the reinforcing cylinders to be inserted in the prepared holes was formed of the WC3009 metal and was 0.09 inch in diameter and 2.4 inches in length. Seven dimensionally conforming cylinders were placed in the 7 drilled holes in each of the cast matrix alloy samples. Each assembly was then enclosed in a jacket of molybdenum metal and was subjected to an 8 to 1 extrusion reduction.

After the first extrusion, a three inch length was cut from the extruded composite billet and the three inch length was placed in a second conforming molybdenum jacket and subjected to a second extrusion operation to produce an 8 to 1 reduction. Total cross-sectional area reduction of the original billet was 64 to 1.

A photomicrograph of the cross section of a twice extruded billet and of the contained reinforcing strands is provided in FIG. 1.

Seven sections were cut from the twice extruded billet and each section was accorded a four hour heat treatment in argon at temperatures as follows: 815° C.; 1050° C.; 1100° C.; 1150° C.; 1200° C.; 1300° C.; and 1400° C.

Grain size measurements were made for both the reinforcing fiber and the matrix on each of these sections of the extruded billet. The initial grain sizes of the matrix portions of the billet sections prior to heat treatment were less than 20 μm. The initial grain sizes were grown to 50 to 100 μm by the 1100° C. heat treatment and to 200 to 300 μm by the 1400° C. heat treatment. The matrix having the higher titanium concentration displayed the greater grain growth.

The grain size in the reinforcing WC3009 fiber could not be measured optically for the as-extruded fiber nor could it be measured for the fiber after the 815° C. heat treatment. The grain size was about 5 μm for the WC3009 fiber which had been treated at the 1050° C. temperature. The grain size of the fiber was less than 25 μm for the sample which had been heat treated at 1400° C.

Figure 2:
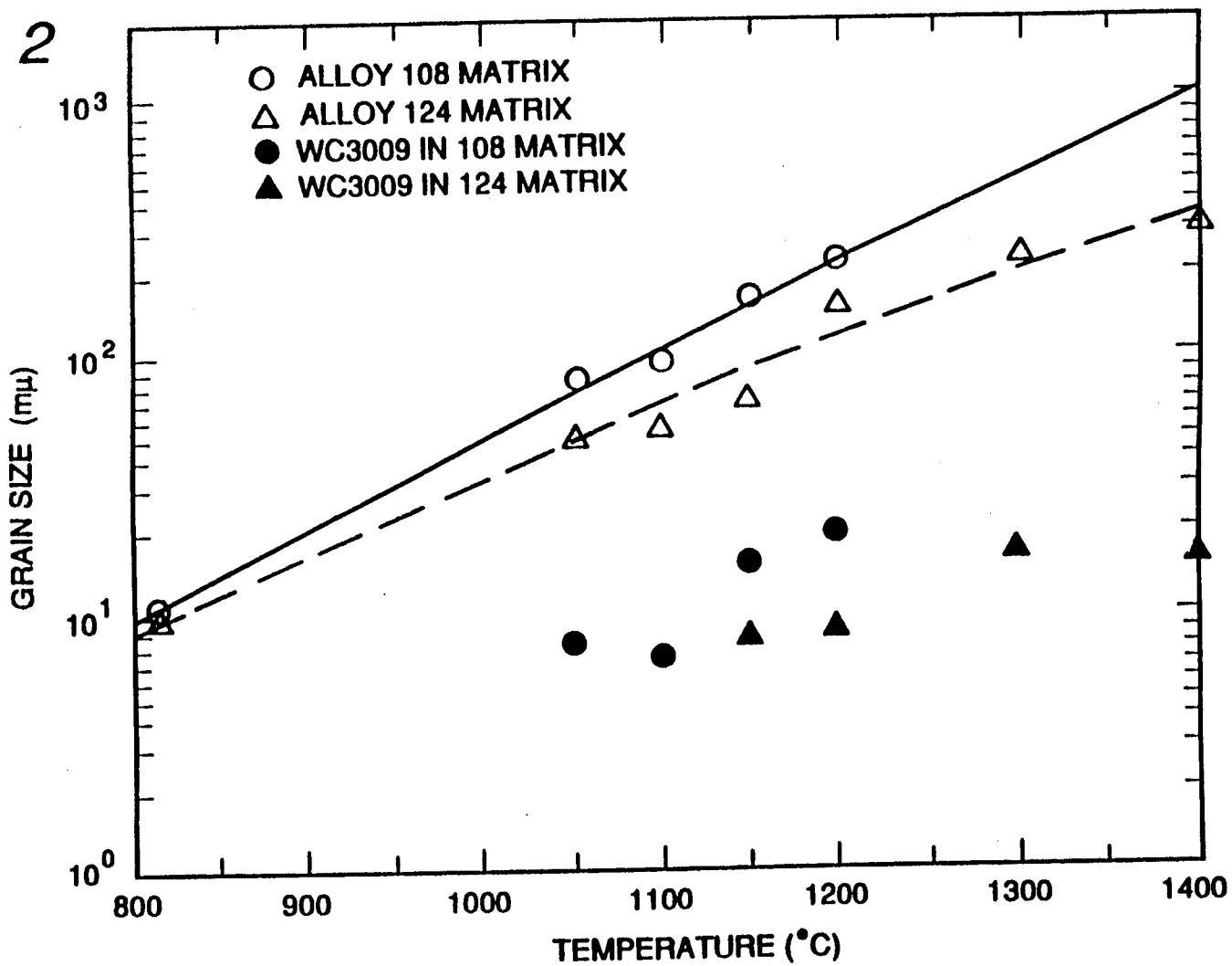
FIG. 2 is a graph in which grain size of the matrix and of the embedded reinforcement is plotted against heat treatment temperature.

A plot of data concerned with grain size in relation to treatment temperature is set forth in FIG. 2.

The interface between the fiber and the matrix and the grain boundaries in the fiber were heavily decorated with precipitates of hafnium oxide ($HfO_2$). It is presumed that the oxygen in the matrix casting and on the fiber surfaces as well as on the matrix machined surfaces reacted with the high hafnium concentrations in the WC3009 fibers.

Mechanical test bars were machined from the twice extruded composites after heat treatment at the 1100° C., 1200° C., and 1300° C. heat treatment temperatures. The test bar gage was 0.08 inches in diameter with the outer gage surface of the matrix being approximately 0.005 inches beyond the outer fiber surface, i.e., each fiber was at least 0.005 inches from the outer surface of the matrix member. The seven fibers were in a close-packed array having six outer fibers surrounding a central fiber on the axis of the test bar as illustrated in FIG. 1. All of the fibers were included within the 0.08 inch gauge diameter of the test bar. Tests were made of the bars as indicated in Table II immediately below:

TABLE II

Test Data for Composite of Continuous Fibers of WC3009 in Alloy Matrix

| Example | Matrix Alloy | Heat Treatment | Test Temp (°C.) | YS (ksi) | UTS (ksi) | εML (%) | εF (%) | R.A. (%) |
|---|---|---|---|---|---|---|---|---|
| | | | RT | 128 | 128 | 0.2 | 23 | 36 |
| 1 | Matrix 108 | 1200 C. | 760 | 81 | 83 | 0.7 | 24 | 50 |
| | | | 980 | 22 | 24 | 0.6 | 40 | 70 |
| | | | 1200 | 10 | 11 | 0.8 | 39 | 96 |
| | | | RT | 131 | 131 | 0.2 | 22 | 35 |
| 2 | Matrix 124 | 1200° C. | 760 | 83 | 92 | 1.8 | 13 | 14 |
| | | | 980 | 35 | 35 | 0.2 | 59 | 76 |
| | | | 1200 | 9 | 14 | 1.4 | 53 | 95 |
| 1 | Matrix 108 | 1100° C. | RT | 126 | 127 | 0.3 | 26 | 37 |
| | | 1300° C. | RT | No Yield | 40 | 0.02 | 0.2 | 0 |
| 2 | Matrix 124 | 1100° C. | RT | 134 | 134 | 0.2 | 26 | 45 |
| | | 1300° C. | RT | 126 | 127 | 0.2 | 3.4 | 6.6 |

It will be observed from the results listed in Table II that the ductility of samples heat treated at 1300° C. decreased sharply when compared to the ductility values achieved following heat treatment at 1100° C. or 1200° C.

Figure 3:
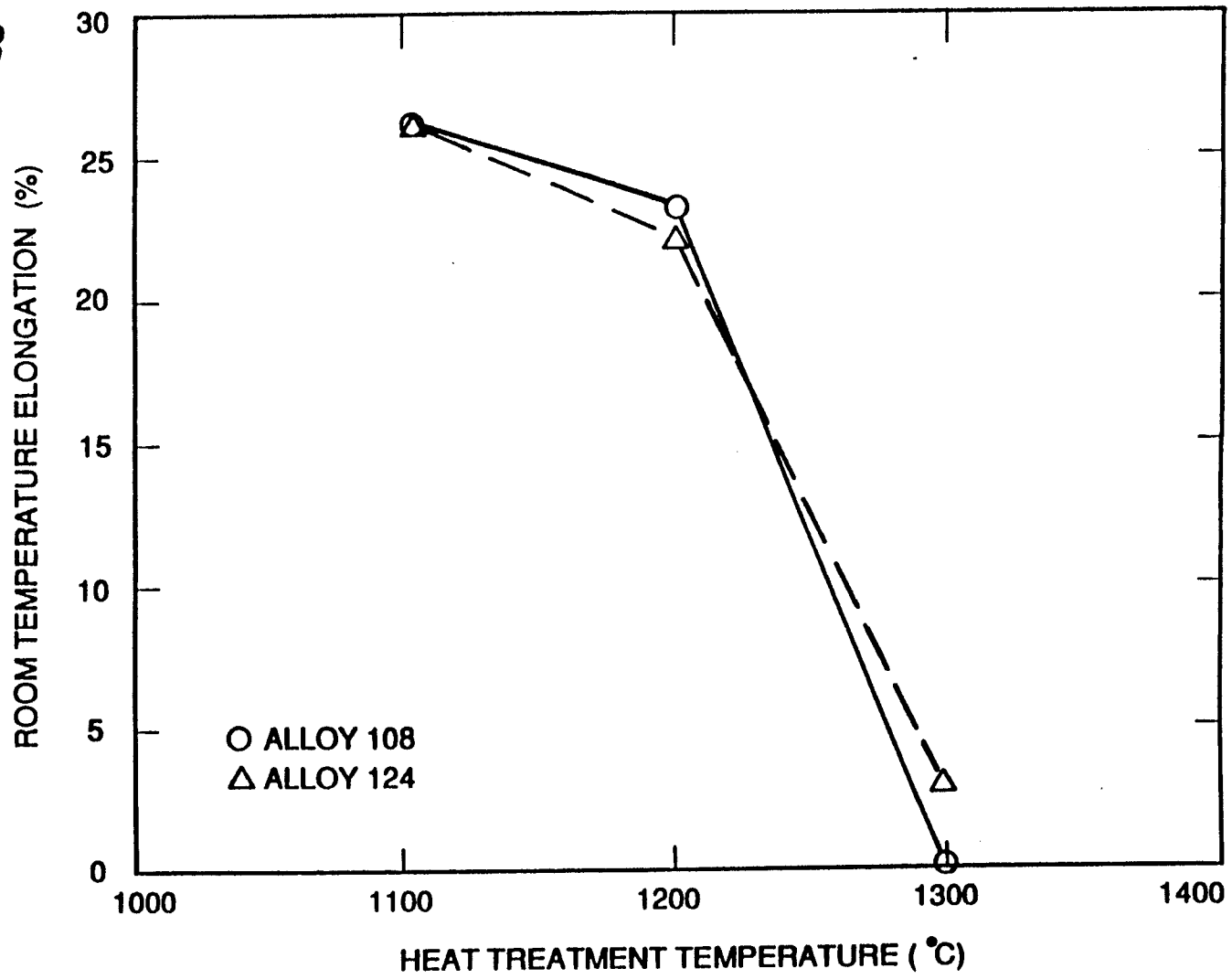
FIG. 3 is a graph in which composite room temperature elongation is plotted against heat treatment temperature.
Figure 4:
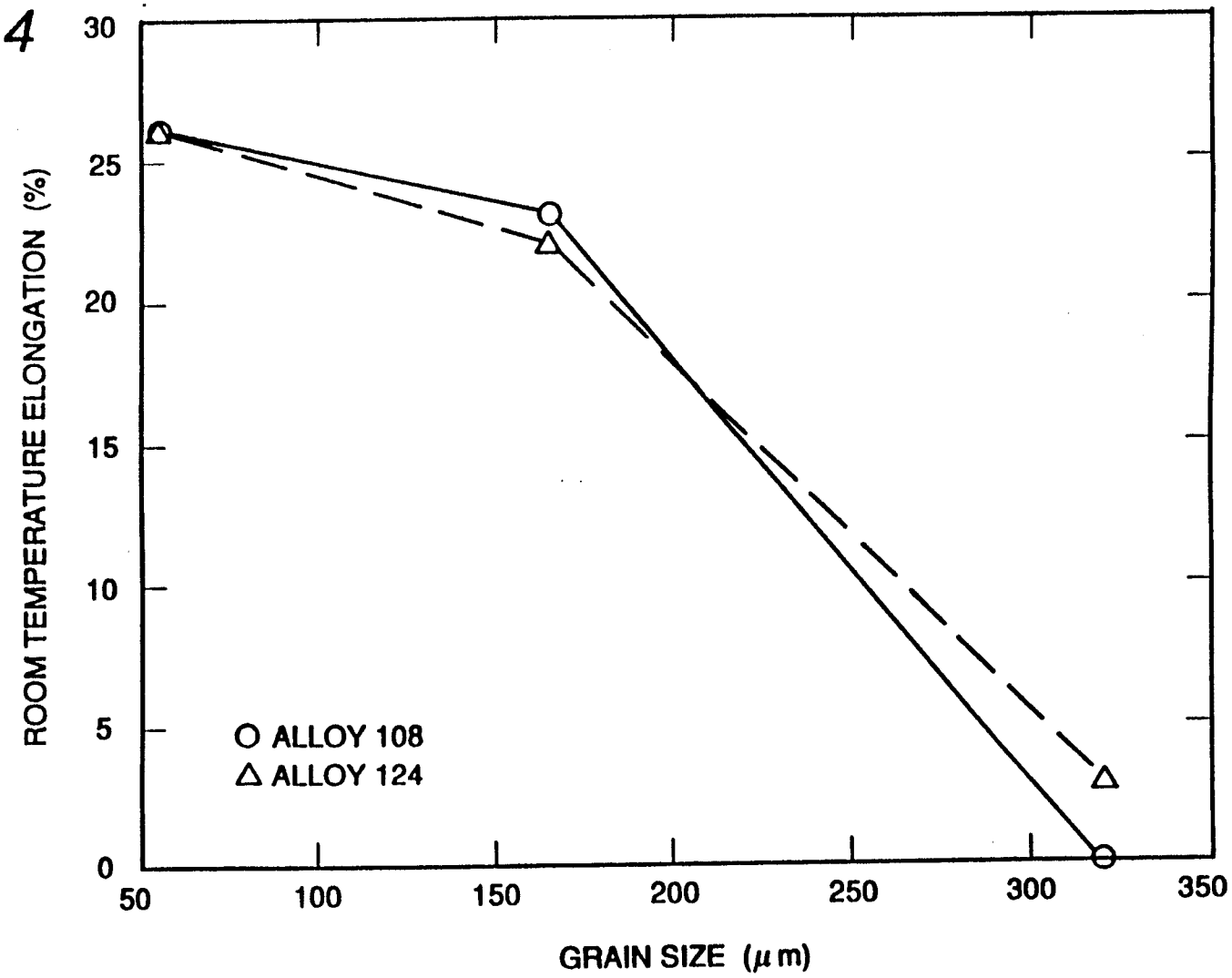
FIG. 4 is a graph in which composite room temperature elongation is plotted against grain size.

A plot of the data relating room temperature to heat treatment temperature as set forth in Table II is presented in FIG. 3. A plot relating grain size to elongation is presented in FIG. 4.

Tensile strengths were essentially in conformity with a rule of mixtures calculation for the respective volume fractions of fiber and matrix. The volume fraction of the materials tested to produce the results listed in Table II were about 15.8 volume percent of the WC3009 reinforcing fibers each of which had a diameter measurement of about 0.012 inches in the test bars subjected to testing. For the samples heat treated at 1100° C. and at 1200° C., both composites exhibited room temperature ductilities of about 22% elongation with about a 35% reduction in area. It was observed that these ductilities were surprisingly high when compared to values of 7–12% typical of similar matrix compositions which contained no fibers. It is known that the WC3009 alloy is generally low in ductility in the range of about 5% in a bulk form at room temperature, although the data which is available is only for the alloy with much coarser grain structures.

Figure 5:
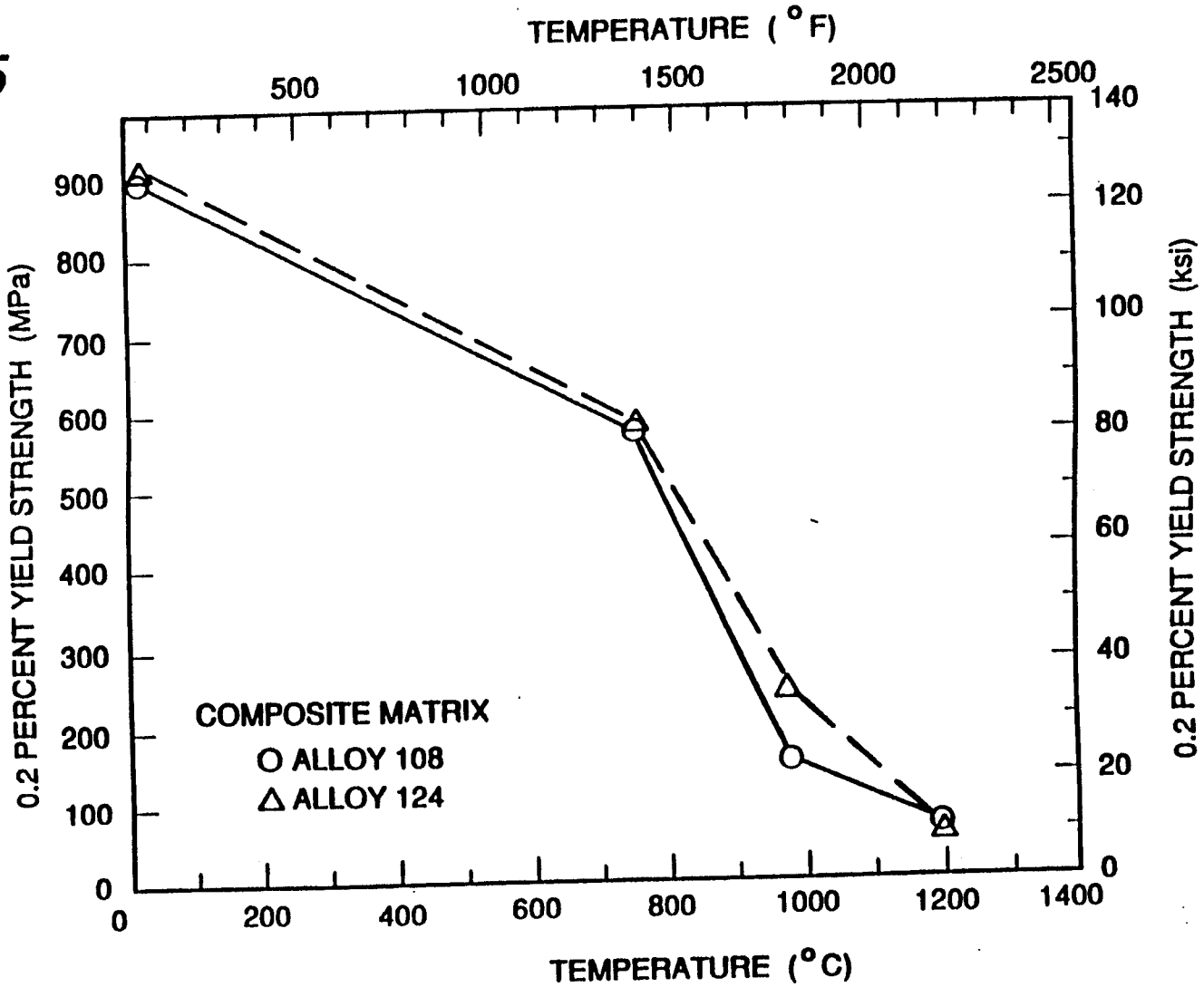
FIG. 5 is a graph in which composite yield strength is plotted against testing temperature
Figure 6:
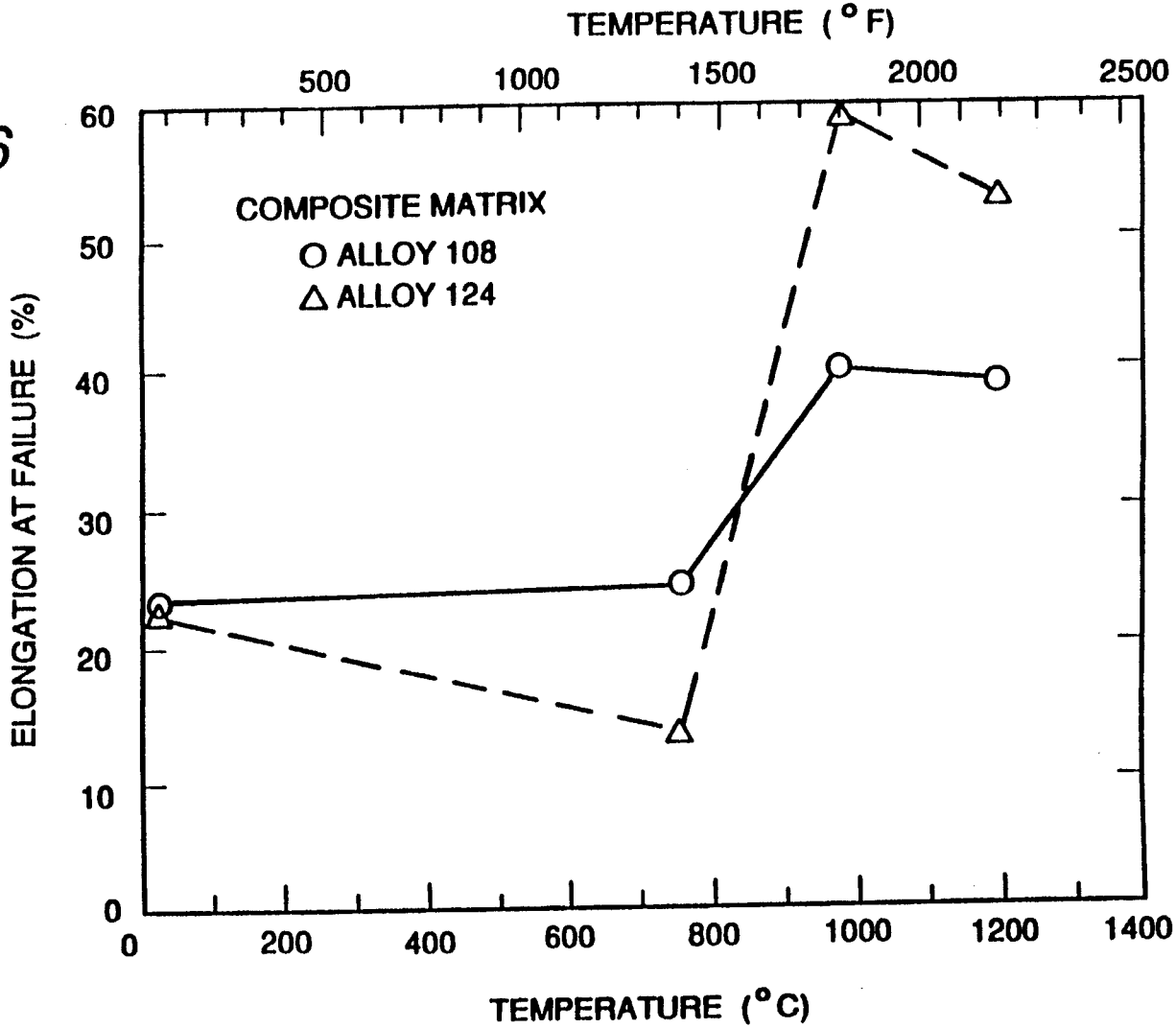
FIG. 6 is a graph in which composite elongation to failure is plotted against testing temperature.

Data relating yield strength to temperature is plotted in FIG. 5 and data relating percent elongation to temperature for each composite is plotted in FIG. 6.

Rupture data for the continuous composite of WC3009 continuous fibers in the niobium based matrices were obtained by measurements made in an argon atmosphere at 985° C. essentially as listed in Table III immediately below:

TABLE III

Rupture Life Data at 985° C. for 15.8 v/o WC3009 Filament in Reinforced Composites

| Example | Continuous Composite with Matrix | Heat Treatment Temperature | Stress (ksi) | εF (%) | RA (%) | Rupture life (hours) |
|---|---|---|---|---|---|---|
| 1 | 124 | 1100° C. | 9 | 81 | 89 | 20.8 |
| | 124 | 1200° C. | 9 | 63 | 63 | 114.3 |
| | 124 | 1300° C. | 9 | 56 | 79 | 43.1 |
| 2 | 108 | 1100° C. | 9 | 64 | 82 | 23.3 |
| | 108 | 1200° C. | 12 | No Data | No Data | 0.6 |

As a matter of comparison, unreinforced alloys similar to the 108 matrix exhibit a rupture life at 985° C. of less than 25 hours at a stress of only 6 ksi. Correspondingly, a unreinforced alloy similar to the 124 matrix exhibited a life of 1.8 hours at 9 ksi.

For reinforced structures as provided pursuant to the present invention, the best composite test life at equal stress was nearly 10 fold greater than the rupture life of a similar unreinforced composition.

The densities for the two composites are approximately 7 grams per cubic centimeter for the composite with the 108 matrix and 7 2 grams per cubic centimeter for the composite with the 124 matrix. Comparable density values for nickel and cobalt based alloys are 8.2 to 9.3 grams per cubic centimeter. Although the composites are much stronger in rupture than are wrought Ni and Co-base superalloys, the composites are still weaker than cast $\gamma/\gamma'$ superalloys. The density reduced stress for 100 hours at 985° C. for the 124 composite is 1.25 (arbitrary units, ksi/g/cc), less than for cast alloys such as René 80 (density reduce stress of 1.84), but is much closer than is the case for unreinforced matrices (density-reduced stress of 0.75).

Rupture data Obtained by measurements made in argon atmosphere at other temperatures are listed in Table IV immediately below:

TABLE IV

Rupture Life Data for 15.8 v/o WC3009 Filament in Reinforced Composites

| Ex. | Continuous Composite with Matrix | Heat Treatment Temperature | Rupture Life (hours At 871° C. and 15 ksi | 1093° C. and 5 ksi | 1149° C. and 3 ksi |
|---|---|---|---|---|---|
| 1 | 108 | 1100° C. | 34.3 | 11.5 | 60.3 |
| 2 | 124 | 1100° C. | 81.6 | 16.1 | 500.5 |
| | 124 | 1300° C. | 46.2 | 42.2 | 372.1 |

Typical wrought Ni and Co superalloys would last less than 100 hours at 1000° C. and 3 ksi. In terms of temperature capability, the reinforced composites having the niobium-titanium base matrices would survive for an equivalent time at a temperature 80° C. to 200° C. hotter than wrought Ni or Co alloys.

Figure 7:
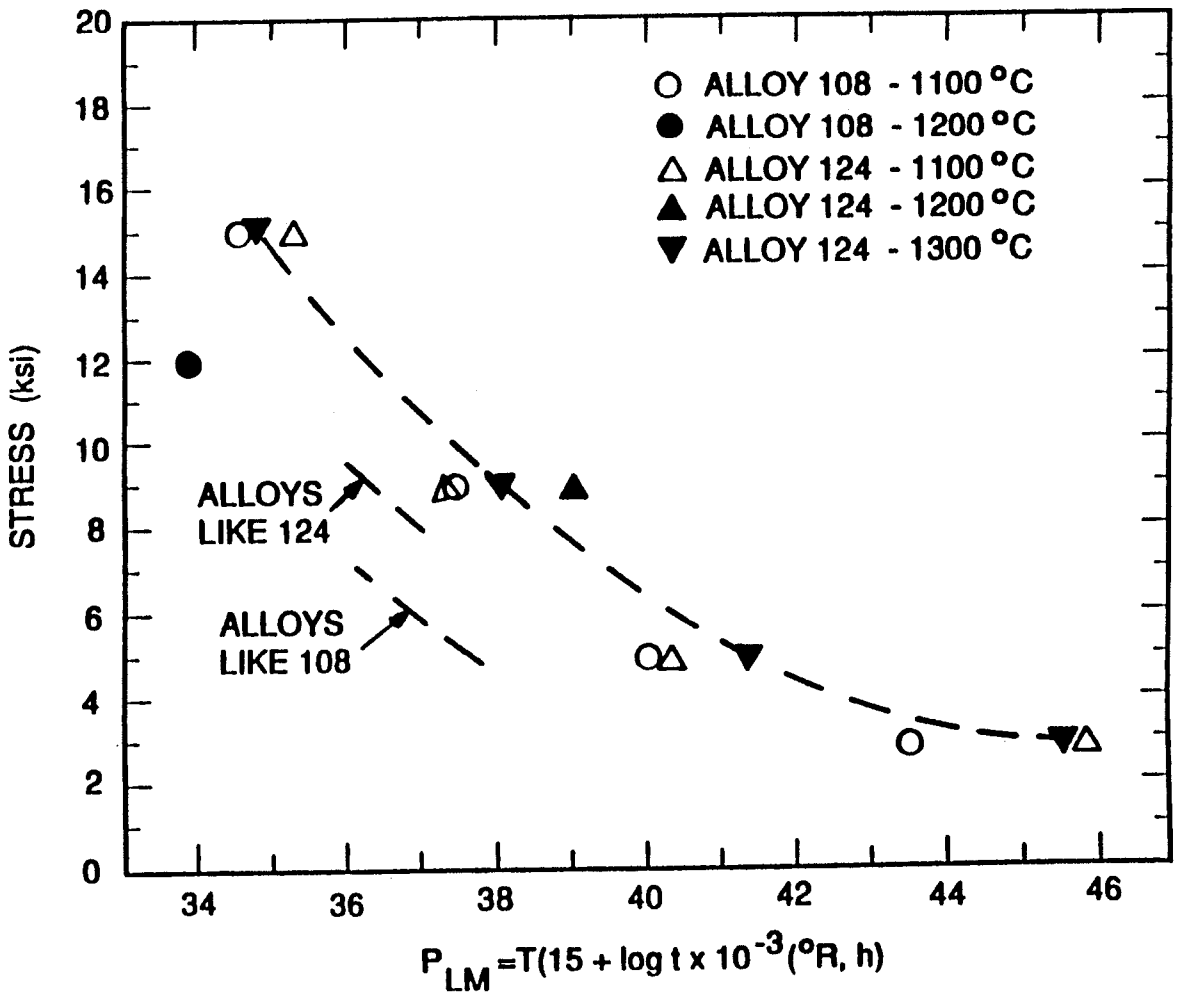
FIG. 7 is a Larson-Miller graph in which comparative data is given regarding the stress rupture life of the composites.

Data concerning the stress rupture life of the composites as described above are set forth in the Larson-Miller plot of FIG. 7.

Some niobium base alloys, other than WC3009, which are suitable for use as strengthening materials include, among others, the following:

TABLE

Of Commercially Available Niobium Base Alloys Useful as Strengthening Elements for the Niobium Base Matrix Metal Having the Formula Nb balance-$Ti_{40-48}$—$Al_{12-22}$—$Hf_{0.5-6}$

| Alloy Designation | Nominal Alloy Additions in Weight % |
|---|---|
| FS80 | 1 Zr |
| C103 | 10 Hf, 1 Ti, 0.7 Zr |
| SCb291 | 10 Ta, 10 W |
| B66 | 5 Mo, 5 V, 1 Zr |
| Cb752 | 10 W, 2.5 Zr |
| C129Y | 10 W, 10 Hf, 0.1 Y |
| FS85 | 28 Ta, 11 W, 0.8 Zr |
| SU16 | 11 W, 3 Mo, 2 Hf, 0.08 C |
| B99 | 22 W, 2 Hf, 0.07 C |
| As30 | 20 W, 1 Zr |

Each of these commercially available alloys contains niobium as its principal alloying ingredient and each of these alloys has a body centered cubic crystal structure. Each of the alloys also contains the conventional assortments and concentrations of impurity elements inevitably present in commercially supplied alloys.

These are alloys which are deemed to have sufficient high temperature strength and low temperature ductility to serve as reinforcing element in composite structures having a niobium-titanium matrix as described above and having a composition as set forth in the following expression:

$$Nb_{balance}\text{-}Ti_{32-48}\text{-}Al_{8-16}\text{-}Cr_{2-12}.$$

The form of the fibers or filaments of the strengthening alloy is a form in which there is at least one small dimension. In other words, the strengthening element may be present as a fiber in which case the fiber has one large dimension and two small dimensions, or it may be present as a ribbon or disk or platelet or foil, in which case the reinforcing structure has one small dimension and two larger dimensions.

A number of additional examples illustrate alternative methods of preparing the composites of the present invention.

EXAMPLE 3

A composite structure was prepared by coextruding a bundle of round rods of matrix and reinforcement alloys.

The matrix (designated alloy 6) of the composite to be formed represented about ⅔ of the number of rods in the bundle and accordingly ⅔ of the volume of the composite. This matrix metal had a titanium to niobium ratio of 0.67.

The matrix contained 27.5 atom percent of titanium, 5.5 atom percent aluminum, 6 atom percent chromium, 3.5 atom percent hafnium, and 2.5 atom percent vanadium and the balance niobium according to the expression:

$$Nb_{balance}\text{-}Ti_{27.5}\text{-}Al_{5.5}\text{-}Cr_{6}\text{-}Hf_{3.5}\text{-}V_{2.5}.$$

The rods of the reinforcing component of the composite were of an AS-30 alloy containing 20 weight percent of tungsten, 1 weight percent of zirconium, and the balance niobium according to the expression:

$$Nb_{balance}\text{-}W_{20}\text{-}Zr_{1}.$$

Approximately 70 rods of reinforcement and 140 rods of matrix having diameters of 60 mils each were employed in forming the composite. The 210 rods were placed in a sleeve of matrix metal. The sleeve and contents were enclosed in a can of molybdenum to form a billet for extrusion. The assembled billet and its contents were then processed through a 10 to 1 ratio extrusion. A section of the extruded product was cut out and this section was re-processed again through a 10 to 1 ratio extrusion. A double extrusion of the rods was thus carried out.

Figure 8:
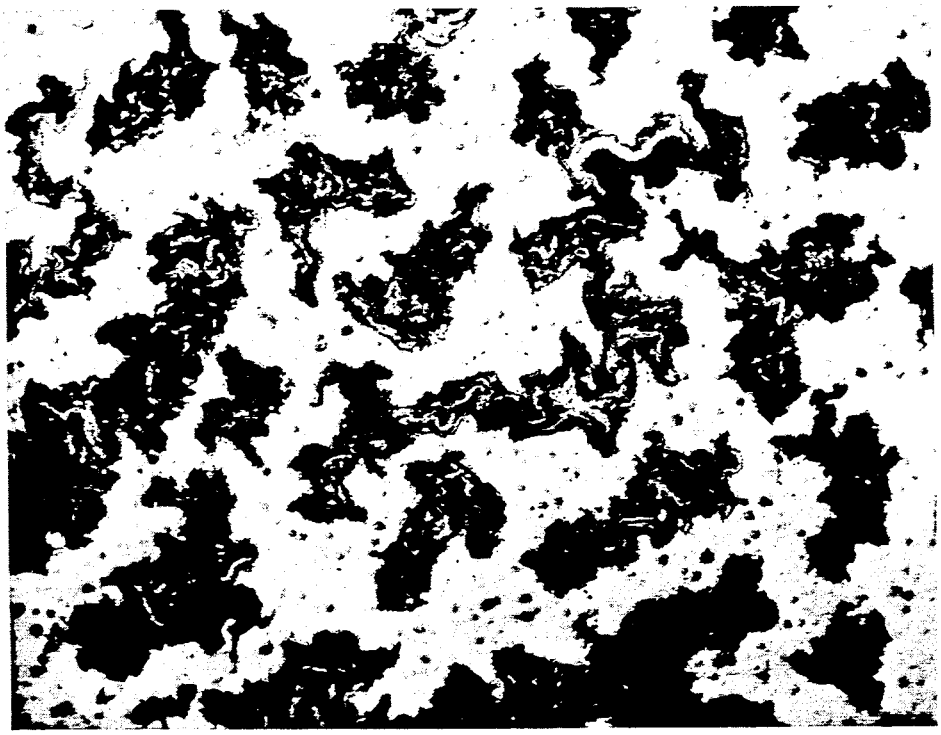
FIG. 8 is a micrograph of a cross section of a continuous composite structure.

Following the double extrusion, the nominal size of each reinforcing fiber was about 150 μm . FIG. 8 is a micrograph of a portion of the cross-section of the structure. It is evident from the micrograph that the rods had lost their identity as round rods. Further, the very irregular shape of the resulting strands formed from the rods within the composite had demonstrated that in a number of cases the elements which started as rods were deformed and in some cases joined with other elements to form the irregular pattern of matrix strands and reinforcement strands which is found in the micrograph of FIG. 8.

Standard tensile bars were prepared from the composite and from the matrix material and tensile tests were performed. The results are set forth immediately below in Table V.

TABLE V

Tensile Results of Continuous Fiber Reinforced and Matrix Alloys

| Ex. | Sample | Alloy | Temp (C) | Yield (ksi) | Ultimate (ksi) | Elongation (ultimate) % | Elongation (failure) % | % RA |
|---|---|---|---|---|---|---|---|---|
| | | Composite | | | | | | |
| 3 | 91-12/A | AS-30/Alloy 6 | 70 | 121.0 | 121.0 | 0.2 | 0.2 | 1.5 |
| | 91-12/B | AS-30/Alloy 6 | 760 | 78.1 | 89.3 | 4.8 | 20.6 | 27.0 |
| | 91-12/C | AS-30/Alloy 6 | 980 | 43.7 | 44.3 | 3.8 | 48.5 | 50.0 |
| | 91-12/D | AS-30/Alloy 6 | 1200 | 22.5 | 25.4 | 2.7 | 65.5 | 56.0 |
| | | Matrix | | | | | | |
| | 91-32 | Alloy 6 | 70 | 132.4 | 132.4 | 0.1 | 23.5 | 46.0 |
| | 91-32 | Alloy 6 | 760 | 83.1 | 92.1 | 1.7 | 48.3 | 64.0 |
| | 91-32 | Alloy 6 | 980 | 42.1 | 42.7 | 0.3 | 95.2 | 95.0 |
| | 91-32 | Alloy 6 | 1200 | 20.4 | 20.4 | 0.2 | 83.2 | 57.0 |

Figure 9:
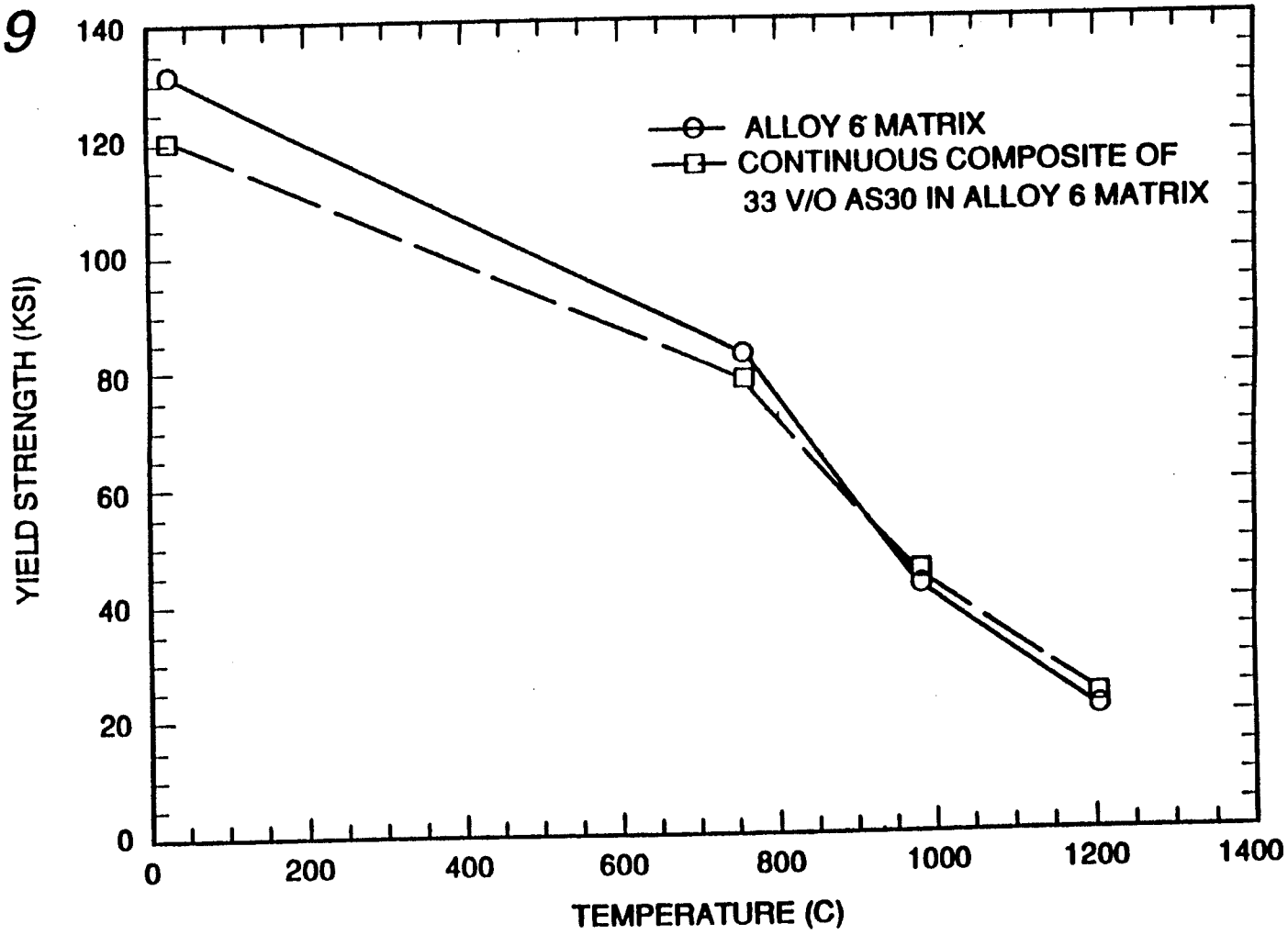
FIG. 9 is a graph in which yield strength is plotted against test temperature.

The yield strength data of this table is plotted in FIG. 9.

It is apparent from a comparison of the data of Table V that the composite has lower strength than the matrix at lower temperatures but has higher strength than the matrix at higher temperatures. The ultimate strength of the composite is about 20% higher than that of the matrix at the 1200° C. testing temperature.

Additional tests of the composite and of the matrix were carried out to determine comparative resistance to rupture. Test results are presented in Table VI immediately below.

TABLE VI

Rupture Results of Continuous Fiber Reinforced and Matrix Alloys

| Ex. | Sample | Alloy | Temperature (C) | Stress (ksi) | Life hours |
|---|---|---|---|---|---|
| | | Composite | | | |
| 3 | 91-12 | AS-30/Alloy 6 | 980 | 12.50 | 1282.36 |
| | 91-12 | AS-30/Alloy 6 | 1100 | 8.00 | 1928.20-Test Stopped |
| | | Matrix | | | |
| | 91-32 | Alloy 6 | 980 | 12.50 | 1.86 |
| | 91-32 | Alloy 6 | 1100 | 8.00 | 0.57 |

A comparison of the data for the composite and the matrix makes clear that a highly remarkable improvement is found in the composite at both test temperatures. The improvement at the higher, 1100° C., test temperature is of the order of thousands of percent. In fact, the test was stopped because the beneficial effect of the reinforcement was already fully demonstrated The form of the reinforcement for the above examples is essentially continuous in that the reinforcement and the matrix are essentially coextensive when examined from the viewpoint of the extended reinforcing strands. Such composites are referred to herein as continuous composites or composites having continuous reinforcing members.

There is also another group of composite structures provided pursuant to the present invention in which the reinforcing members are discontinuous. In these composites, the reinforcing strands do not extend the full length of the matrix itself but extends a significant length and may also extend a significant width within the matrix but such reinforcements have at the least a single small dimension which in reference to length and width, is designated as thickness. Accordingly, the present invention contemplates discontinuous composites or composites in which the reinforcement is discontinuous where the reinforcement may be in the form of platelets or lengths of ribbon or strands or foil but where the reinforcement does not extend the full length of the long dimension of the matrix.

Such composites having discontinuous reinforcement may be prepared pursuant to the present inventions by a powder metallurgical processing by providing a mix of matrix and reinforcing metal powdered elements. The matrix must be the larger volumetric fraction of the mix. The matrix may be a powder, or flakes, or other matrix elements of random shape and size so long as the shape and size permit the matrix to be the fully interconnected medium of the composite. The reinforcement must be the smaller volumetric fraction of the mix of elements. The reinforcement may be powder, or flakes, or needles, or ribbon or foil segments, or the like. Illustratively, a composite having discontinuous reinforcement may be prepared from a mix of powders including a matrix powder and a reinforcement powder and by mechanically or thermomechanically working the mix of powders both to consolidate the powders and also to extend the powders in at least one major dimension. For example, where a composite is formed from a mix of matrix and reinforcement powders and the consolidated powders are subjected to an extrusion or a rolling action of both, the matrix and the reinforcement are extended in the direction in which the rolling or extrusion is carried out. The result of such action is the formation of a composite having discontinuous reinforcing elements extended in the direction of extrusion or rolling. Such a structure has been found to have superior properties when compared to the matrix material by itself. The following are some examples in which this development of composites having discontinuous reinforcement was carried out.

EXAMPLES 1-6

A number of discontinuous composites were prepared. To do so, two sets of alloy powders were prepared. A first set was a matrix alloy and a second set was a reinforcing alloy.

The matrix powder was a powder of a niobium based alloy having a titanium to niobium ratio of 0.85. The alloy identified as matrix alloy GAC had the composition as set forth in the following expression:

Matrix Alloy GAC: $Nb_{balance}$-36.9Ti-8Cr-7.9Al-2Hf.

Powder of this alloy was prepared by conventional inert gas atomization processing.

Also, a sample of AS-30 alloy, the composition of which is identified in Example 3 above, was converted to powder by the hydride-dehydride processing. According to this process, a billet of the material is exposed to hydrogen at 900°-1,000° C. The alloy embrittles from the absorption of hydrogen. Once it has been embrittled the billet is crushed by a jaw crusher or by ball milling to make the powder from the embrittled alloy of the billet.

Following the pulverization of the billet, the powder is exposed in vacuum to a 900°-1,000° C. temperature to remove hydrogen from the powder thus restoring ductility of the metal. The AS-30 alloy was converted to powder by this process.

In all, three batches of matrix powder and three batches of powder to serve as a reinforcement were prepared. The discontinuous composite powder samples prepared by extrusion of powder blends were identified as 91-13, 91-14, and 91-27.

The matrix alloy was produced by extrusion of the GAC matrix alloy powder alone and this extruded product was identified as 91-26.

In the three examples described herewith, powder mixes were prepared. In the first powder mix, 91-13, the mix contained ⅔ of the matrix alloy and ⅓ of the As-30 metal prepared by the hydride-dehydride process.

In the second powder blend, identified as 91-14, the blend contained ⅔ of the matrix powder and ⅓ of WC3009 powder prepared by the hydride-dehydride process.

The third batch of powder, identified as 91-27, contained ⅔ of the matrix powder and ⅓ of a WC3009 spherical powder The spherical powder was prepared by a PREP (Plasma Rotating Electrode Process) process which involved rotating a billet of the WC3009 alloy at a speed of about 12,000 revolutions per minute. The end of the billet was melted in a plasma flame as the billet spun. Centrifugal forces stripped the liquid from the end of the billet as it spun, and as the end was melted this action resulted in atomization of the metal into small liquid droplets which solidified in flight into a fine powder of spherical particles.

For each of the above three batches of mixed powders or blends, the individual powder blends were poured into a decarburized steel can as the can was mechanically vibrated. When the pour was completed for each can, the can was evacuated and sealed. Each sealed can was then enclosed in a heavy walled stainless steel jacket to form a billet. The billets were then hot compacted to full density and were then hot extruded to achieve a 10:1 area reduction.

Accordingly by these procedures, the individual blends of powder were consolidated by heat and pressure and the consolidated powder blends were then extruded to cause the particles of the reinforcing powder to be deformed into elongated particles which served as reinforcing strands.

Tensile tests were performed on the composite and on the matrix and the results of these tests are set forth in Table VII below.

TABLE VII

Tensile Results of Discontinuous Composite of Fiber Reinforced Matrix Alloys

| Ex. | Sample | Alloy | Temp (C) | Yield (ksi) | Ultimate (ksi) | Elongation (ultimate) % | Elongation (failure) % | % RA |
|---|---|---|---|---|---|---|---|---|
| | | Composite | | | | | | |
| 4 | 91-13/1C | AS-30/Alloy GAC | 70 | no yield | 92.0 | 0.002 | 0.002 | 1.5 |
| | 91-13/2I | AS-30/Alloy GAC | 760 | 83.2 | 88.2 | 1.0 | 1.8 | 5 |
| | 91-13/2J | AS-30/Alloy GAC | 980 | 38.3 | 38.7 | 0.4 | 15 | 16 |
| | 91-13/2F | AS-30/Alloy GAC | 1200 | 18.3 | 19.1 | 1.1 | 33 | 29 |
| | | Composite | | | | | | |

TABLE VII-continued

Tensile Results of Discontinuous Composite of Fiber Reinforced Matrix Alloys

| Ex. | Sample | Alloy | Temp (C) | Yield (ksi) | Ultimate (ksi) | Elongation (ultimate) % | Elongation (failure) % | % RA |
|---|---|---|---|---|---|---|---|---|
| 5 | 91-14/2L | WC-3009/Alloy GAC | 70 | 136.8 | 139.3 | 2.2 | 14 | 27 |
| | 91-14/2K | WC-3009/Alloy GAC | 760 | 92.5 | 100.3 | 1.9 | 20 | 25 |
| | 91-14/1O | WC-3009/Alloy GAC | 980 | 46.3 | 46.5 | 0.3 | 20 | 15 |
| | 91-14/2N | WC-3009/Alloy GAC | 1200 | 23.7 | 26.9 | 1.5 | 23 | 16 |
| | | Matrix | | | | | | |
| | 91-26/D | Alloy GAC | 70 | 144.5 | 144.5 | 0.1 | 8 | 22 |
| | 91-26/C | Alloy GAC | 760 | 93.1 | 95.8 | 0.6 | 54 | 69 |
| | 91-26/B | Alloy GAC | 980 | 29.2 | 29.2 | 0.2 | 112 | 95 |
| | 91-26/A | Alloy GAC | 1200 | 10.9 | 10.9 | 0.2 | 207 | 97 |
| | | Composite | | | | | | |
| 6 | 91-27/D | WC-3009/Alloy GAC | 70 | 134.2 | 135.6 | 1.7 | 16 | 31 |
| | 91-27/E | WC-3009/Alloy GAC | 760 | 87.9 | 96.3 | 1.6 | 14 | 18 |
| | 91-27/H | WC-3009/Alloy GAC | 980 | 42.6 | 42.9 | 0.4 | 14 | 14 |
| | 91-27/J | WC-3009/Alloy GAC | 1200 | 23.0 | 25.0 | 1.0 | 19 | 11 |

It is evident from the data set forth in Table VII above that the yield strengths of the samples for all three composites are less at room temperature than the yield strength of the matrix itself. However, at 1200° C., all of the test data establishes that the composite structures have higher yield strengths than that of the matrix material. Further, it is evident from the results set forth in Table VII that the ultimate tensile strength is lower at the room temperature test condition but that the ultimate tensile strength is higher at the elevated temperature of 1200° C. for each of the Examples 4, 5, and 6 than for the matrix alloy GAC.

A series of comparative rupture tests were also carried out on the composites and matrix structures and the results are set forth in Table VIII below.

TABLE VIII

Rupture Test Results for Discontinuous Fiber Reinforced and Matrix Alloys

| Ex. | Sample | Alloy | Temperature (C) | Stress (ksi) | Life hours |
|---|---|---|---|---|---|
| | | Composite | | | |
| 4 | 91-13 | AS-30/Alloy GAC | 980 | 12.50 | 15.80 |
| | 91-13 | AS-30/Alloy GAC | 1100 | 8.00 | 7.87 |
| | 91-13 | As-30/Alloy GAC | 980 | 10.00 | 103.74 |
| | 91-13 | AS-30/Alloy GAC | 1100 | 5.00 | 594.55 |
| | | Composite | | | |
| 5 | 91-14 | WC-3009/Alloy GAC | 980 | 12.50 | 20.52 |
| | 91-14 | SC-3009/Alloy GAC | 1100 | 8.00 | 10.6–19.2 |
| | 91-14 | WC-3009/Alloy GAC | 980 | 10.00 | 34.09 |
| | 91-14 | WC-3009/Alloy GAC | 1100 | 5.00 | 73.29 |
| | | Matrix | | | |
| | 91-26 | Alloy GAC | 980 | 12.50 | 1.05 |
| | 91-26 | Alloy GAC | 1100 | 8.00 | 0.25 |
| | | Composite | | | |
| 6 | 91-27 | WC-3009/Alloy GAC | 980 | 12.50 | 7.94 |
| | 91-27 | WC-3009/Alloy GAC | 1100 | 8.00 | 8.97 |

It is evident from the data set forth in Table VIII above that the rupture test values at the 980° C. temperature are significantly higher for the composite structures of Examples 4, 5, and 6 than the test value for the matrix Alloy GAC sample.

Further, the advantage of greater rupture life expectancy is higher for the composite structures of Examples 4, 5, and 6 than it is for the matrix Alloy GAC. sample.

Accordingly, it is clear from the data of Tables VII and VIII that significant gains are made in the discontinuous composites when the properties including strength and rupture life are compared to those of the matrix.

In general, the composites of the present invention have superior properties which properties are oriented in the longer dimensions of the reinforcing segment. As indicated above, the reinforcement may be in the form of strands which may have a single long dimension and two small dimensions or may be in the form of ribbons or platelets or foils having a single small dimension and two significantly larger dimensions.

The composite structure of the present invention may be formed into reinforced rod or reinforced strip or reinforced sheet as well as into reinforced articles having three large dimensions. Examples of formation of articles of the present invention into rods are illustrated above where extrusion processing is employed. Strip or sheet articles can be formed by similar methods. In each case, the reinforcing metal must be a niobium base metal such as one of those listed above in the table of alternative reinforcing metals which has a body centered cubic crystal form. Extrusion, rolling, and swaging are among the methods which may be used to form composite articles in which both the matrix and the reinforcing core are niobium based metals having body centered cubic crystal form and in which the matrix metal is one which conforms to the expression $$Nb_{balance}\text{-}Ti_{32\text{-}48}\text{-}Al_{8\text{-}16}\text{-}Cr_{2\text{-}12}.$$

The reinforcement of these structures is distributed in the sense that it is in the form of many elements having at least one small dimension. Such elements are referred to herein as strands of reinforcement. Such strands may be in the form of ribbon or ribbon segments or fibers or filaments or platelets or foil or threads or the like, all of which have at least one small dimension and all of which are referred to herein as strands.

One advantage of having large numbers of such strands distributed in the matrix and essentially separated from each other by matrix material is that if an individual strand is exposed to oxidation it can oxidize without exposing all of the other strands, individually sealed within matrix material to such oxidation. The reinforcing function of the other strands is thus preserved.

Further in this regard it will be realized that an essential advantage of the structures of the present invention is that the reinforcement is distributed within the matrix so that the reinforcement is present in a distributed form. For example, the reinforcing rods of Examples and 2 are distributed in a circular pattern with a seventh rod at the center. In Example 3 the rods are distributed in a more random pattern, as illustrated in FIG. 8, and in Examples 4–6 the reinforcement is distributed in an even more random fashion including both laterally and longidudinally. In general this distributed form of the reinforcement within the matrix has been shown to enhance the properties of the composite.

Also generally the reinforcement must remain as reinforcement during the use of the composite article. By this is meant that the dimensions of the reinforcement within the matrix must be sufficiently large so that the reinforcing element does not diffuse into the matrix and lose its identity as a separate niobium based alloy. The extent of diffusion depends, of course, on the temperature of the composite during its intended use as well as on the duration of the exposure of the composite to a high temperature during such use. In the case of a composite formed of a matrix having a melting point of about 1900 degrees centigrade and a reinforcing phase having a melting point of about 2475 degrees centigrade, an initial estimate, based on conventional calculations is that such a composite structure having reinforcement strands of about 20$\mu$ in diameter or thickness would be stable against substantial interdiffusion for times in excess of 1000 hours at 1200 degrees centigrade, and for times approaching 1000 hours at 1400 degrees centigrade.

Accordingly where the composite is to be exposed to very high temperatures it is perferred to form the composite with reinforcing elements having larger cross sectional dimensions so that any interdiffusion which does take place does not fully homogenize the reinforcing elements into the matrix. The dimensions of a reinforcing element which are needed for use at any particular Combination of time and temperature can be determined by a few scoping experiments and from conventional diffusivity calculations since all of the parameters needed to make such tests, calculatiions and determination, based on the above text, are available to the intended user. Thus a reinforcing element having cross sectional dimensions as small as 5 microns can be used effectively for extended periods of time at temperatures below about 1000 degrees centigrade. However the same reinforcing element will be homogenized into the matrix if kept for the same time at temperatures above 1400 degrees centigrade. As a specific illustration of how the present invention may be practiced, the reinforcing elements of the composites of Examples 1 and 2 had diameters of about 12 mils (equal to about 300 microns) and such reinforcement can be used at high temperatures for a time during which some interdiffusion takes place at the interface between the matrix and the reinforcing elements without significant impairment of the improved properties of the composite.

Generally it is desirable to have the reinforcing elements distributed within the matrix so that there is a relatively large interfacial area between the matrix and the reinforcing elements contained within the matrix. The extent of this interface depends essentially on the size of the surface area of the contained reinforcement. A larger surface area requires a higher degree of subdivision of the reinforcement.

As a convenience in describing the degree of subdivision of the reinforcement within the matrix of a composite a reinforcement ratio, R, is used. The reinforcement ratio, R, is the ratio of surface area of the reinforcement in square centimeters to the volume of the reinforcement in cubic centimeters. The reinforcement ratio is thus expressed as follows:

$$R = \frac{\text{Surface Area (square centimeters)}}{\text{Volume (cubic centimeters)}}$$

As an illustration of the use of this ratio consider a solid cube of reinforcement measuring one centimeter on an edge. This is one cubic centimeter of reinforcement. Its ratio, R, is the 6 square centimeters of surface area divided by the volume in cubic centimeters, i.e., 1 cc. So the ratio, R, is equal to 6. For a cube of reinforcement measuring 2 centimeters on an edge the surface area for each of the six surfaces of the cube is 4 square centimeters for a total of 24 square centimeters. The volume of a cube which measures two centimeters on an edge is eight cubic centimeters. So the ratio, R, for the two centimeter cube is 24/8 or 3. For a cube measuring three centimeters on an edge the ratio, R, is 54/27 or 2. From this data it is evident that as the bulk of reinforcement within a surface keeps increasing (and the degree of subdivision keeps decreasing) the ratio, R, keeps decreasing. Pursuant to the present invention what is sought is a composite structure having a higher degree of subdivision of the reinforcement rather than the lower degree.

As a further illustration of the use of this ratio, consider a slab of reinforcement which is embedded in matrix and which is more distributed rather than less distributed as in the above illustration. The slab can be, for example, 40 cm long, 20 cm wide and 1 cm thick. The surface area of such a slab is 1720 sq cm and the volume is 800 cubic cm. The reinforcement ratio, R, for the slab is 1720/800 or 2.15. If the thickness of the slab is reduced in half then the ratio, R, becomes 1660/400 or 4.15. If the thickness of the slab is reduced again, this time to one millimeter (1 mm), the ratio, R, becomes 1612/80 or 20.15.

The thickness (diameter) of the reinforcement in the Examples 1 and 2 above is about 12 mils. Twelve mils is equal to about 300 microns and 300 microns is equal to about 0.3 mm. A reinforcement of about 0.3 mm in the above illustration would have a ratio, R, of about 1604/24 or about 67. However in the case of Examples 1 and 2 the reinforcement was present in the form of filaments rather than in the form of a foil. An array of filaments or strands has, in general, a larger surface area than that of a foil and also has a smaller volume of reinforcement than that of a foil. A row of round filamentary reinforcements of 0.3 mm diameter arranged as a layer within a matrix would have a ratio, R, of 100 or more.

In the case of the Examples 1 and 2 above the filaments were not present as a row in a matrix so as to constitute a layer and in fact were present only to the extent of about 16 volume percent. Never the less the reinforcement of Examples 1 and 2 was clearly effective in improving the properties, and particularly the rupture properties, of the composite.

It should be understood that the reinforcement ratio, R, does not describe, and is not intended to describe the volume fraction, nor the actual amount, of reinforcement which is present within a composite. Rather the reinforcement ratio, R, is meant to define the degree of and the state of subdivision of the reinforcement which is present, and this degree is expressed in terms of the ratio of the surface area of the reinforcement to the volume of the reinforcement. An illustration of the degree of subdivision of a body of reinforcement may be helpful.

As indicated above, a single body of one cubic centimeter of reinforcement has a surface area of 6 sq. cm. and a volume of 1 cubic centimeter (1 cc.). If the body is cut vertically parallel to its vertical axis 99 times at 0.1 mm increments to form 100 slices each of which is 0.1 mm in thickness, the surface area of the reinforcement is increased by 198 sq. cm.(2 sq cm. for each cut) but the volume of the reinforcement is not increased at all In other words the degree of subdivision, and hence the surface area, of the body has been increased but the volume has not been increased. In this illustration the reinforcement ratio, R, is increased from 6 for the solid cube to 204 for the sliced cube without any increase in the quantity of reinforcement.

Pursuant to the present invention it is desirable to have the reinforcement in a subdivided form so that the reinforcement ratio is higher rather than lower. A reinforcement ratio, R, in excess of 50 is desirable and a ratio in excess of 100 is preferred.

Also it is desirable to have the subdivided reinforcement distributed within the matrix to all those portions in which the improved properties are sought. For many composite structures the reinforcement should not extend to the outermost portions as these portions are exposed to the atmosphere The outermost portions should preferably be the more protective matrix alloy:

$$Nb_{balance}\text{-}Ti_{32\text{-}48}\text{-}Al_{8\text{-}16}\text{-}Cr_{2\text{-}12}.$$

Further, the reinforcement must be present in a volume fraction of less than half of the composite. In this regard it is important that the matrix constitute the continuous phase of the composite and not the discontinuous phase. For a well distributed reinforcement the improvement in properties can be achieved at volume fractions of 5 percent and greater.

What is claimed is:

1. A metal-metal composite structure adapted to use at temperature above 1,000 degrees centigrade which comprises a body of a matrix alloy having a composition in atom percent according to the following expression:

$$Nb_{balance}\text{-}Ti_{32\text{-}48}\text{-}Al_{8\text{-}16}\text{-}Cr_{2\text{-}12}$$

provided that the sum (Al+Cr)<=22a/o, and where Ti is less than 37a/o the sum (Al+Cr)<=1-6a/o, said body having distributed therein a multitude of ductile reinforcing strand structures of a niobium base alloy having a body centered cubic crystal form to form a composite, and said composite being ductile and having higher tensile and rupture strength at temperatures above 1,000 degrees centigrade than that of the matrix alloy.

2. The structure of claim 1 in which the matrix alloy contains 32–36.9 Ti, 8–12 Al, 2–8 Cr, balance Nb, with the sum (Al+Cr)<=16 a/o.

3. The structure of claim 1 in which the matrix alloy contains 42.5–48 Ti, 8–16 Al, 2–10 Cr, balance Nb, with the sum (Al+Cr)<=22 a/o.

4. The structure of claim 1, in which the reinforcing strand structures are present to at least 5 volume percent.

5. The structure of claim 1, in which a reinforcement ratio, R, is at least 50.

6. The structure of claim 1, in which a reinforcement ratio, R, is at least 100.

7. The structure of claim 1 in which the composite structure is solely matrix material in its outer most portion.

8. The structure of claim 1, in which the niobium base alloy is Nb-30Hf-9W.

9. The structure of claim 1, in which the niobium base alloy is Nb-W20-Zr1.

10. The structure of claim 1, in which the composite is for use at temperatures up to 1400° C. and each ductile reinforcing strand structure has a thickness of at least 20 microns.

* * * * *